US005949898A

United States Patent [19]

Proni

[11] Patent Number: 5,949,898

[45] Date of Patent: Sep. 7, 1999

[54] SURROUND FOR A LOUDSPEAKER

[76] Inventor: Lucio Proni, 2571 Mayfair La., Weston, Fla. 33327

[21] Appl. No.: 08/921,814

[22] Filed: Sep. 2, 1997

Related U.S. Application Data

[63] Continuation of application No. 08/501,902, Jul. 13, 1995, Pat. No. 5,687,247.

[51] Int. Cl.[6] ..... H04R 1/00; H04R 9/06

[52] U.S. Cl. ..... 381/398; 381/433; 181/171

[58] Field of Search ..... 381/398, 386, 381/432, 396, 411, 433, FOR 153; 181/171, 172, 173

[56] References Cited

U.S. PATENT DOCUMENTS

| | | | |
|---|---|---|---|
| 1,778,693 | 10/1930 | Semple, Jr. | 381/386 |
| 3,684,052 | 8/1972 | Sotome | 381/398 |
| 4,433,214 | 2/1984 | Jasinski | 381/398 |
| 4,591,672 | 5/1986 | Kato et al. | 381/398 |
| 5,371,805 | 12/1994 | Saiki et al. | 381/398 |
| 5,748,759 | 5/1998 | Croft et al. | 381/398 |

*Primary Examiner*—Paul Loomis
*Assistant Examiner*—Rexford N Barnie
*Attorney, Agent, or Firm*—Holland & Knight LLP

[57] ABSTRACT

An improved surround design for a loudspeaker assembly is disclosed wherein the outside edge of the surround is attached to the outer edge of the loudspeaker's frame via a permanent or removable means. When removably attached, access to the mounting holes of the loudspeaker frame is accomplished by moving the roll to one side, prior to the attachment of the securing means. The method of attachment can vary, and in several embodiments includes the use of a annular o-ring, while in another attaching embodiment the use of a locking finger is provided.

17 Claims, 6 Drawing Sheets

SURROUND FOR A LOUDSPEAKER

This application is a continuation of U.S. application Ser. No. 08/501,902, filed Jul. 13, 1995, now U.S. Pat. No. 5,687,247.

BACKGROUND OF THE INVENTION

1. Field of the Invention

The present invention relates generally to the field of loudspeakers and in more particular to an improved outer-suspension design for a loudspeaker.

2. Description of the Prior Art

In the design of loudspeakers, the suspension system in any loudspeaker is normally comprised of two elements, the surround (front or outer suspension) and the spider (rear suspension). The surround is the mechanical device which holds the outer edge of the diaphragm/cone of the loudspeaker. Often the word "roll" is used in place of "surround" when describing the front suspension. Surrounds can be constructed from several materials including rubber, compressed foam rubber, corrugated cloth, paper, plastic, etc. Roll surrounds have a single, large, semi-circular corrugation typically constructed from rubber, compressed foam rubber or treated fabric.

Surrounds help keep the cone centered and provide a portion of the restoring force that keeps the voice coil in the gap created between the pole piece and top plate of the loudspeaker. The surround also provides a damped termination for the edge of the cone. The choice of thickness and material type for surround construction can greatly alter the response of the loudspeaker.

The spider, commonly constructed from treated corrugated fabric, also keeps the voice coil concentric to the pole piece, as well as providing a portion of the restoring force that maintains the voice coil within the gap. The stiffness of the spider can greatly affect the loudspeaker's resonance. The spider also provides a barrier for keeping foreign particles away from the gap area.

Surrounds are one of the primary limiting factors in designing long-excursion loudspeakers. Excursion is defined as the amount of linear length the cone body can travel. With the conventional small roll diameters currently in use, the excursion is often limited by the surround's physical limits. Larger surrounds cannot be used without an attendant loss in effective cone area for a loudspeaker of given outside diameter, thus, creating an inevitable trade-off. Excursion and cone area are the two factors which contribute to a loudspeaker's volume displacement. The higher the volume displacement capability of a loudspeaker, the greater the loudspeaker's ultimate low frequency output potential can be.

In addition to controlling the linear motion of the cone, the surround also acts as a major centering force for the loudspeaker's voice coil. This centering force prevents the voice coil and former from rocking and rubbing against the pole piece or top plate.

Presently, the surround is typically glued to the inner top edge of a flat extension or rim on the outside of the loudspeaker's frame, which also acts as the loudspeaker's mounting flange. With such assembly method, a significant amount of cone area is sacrificed, relative to the loudspeaker's overall footprint (outside diameter). The cone area is a major contributing factor to a loudspeaker's output and efficiency. The sacrifice in cone area is seen as a necessary evil because of the need to provide an accessible mounting flange for the loudspeaker.

Furthermore, current methods for replacing moving parts of a cone loudspeaker, for the purpose of repair, require special skill, tools and adhesives. Typically, the moving parts are cut away and the loudspeaker frame and motor structure (magnet and metal parts that complete the magnetic circuit) are stripped down with chemicals or hand scraped to remove adhesive residue. Once the frame is stripped, new moving parts must be glued together, aligned carefully and glued to the loudspeaker frame. This repair or replacement assembly process normally is handled by trained loudspeaker technicians and requires specialized gauges or alignment spacers for each loudspeaker, as well as a high degree of precision in order to be successful.

Some current small dome loudspeakers, primarily tweeters, and compression drivers feature the ability to quickly remove and replace their moving parts. This is facilitated greatly in these designs due to the lack of a rear suspension or spider. In these designs, the diaphragm, voice coil and surround are typically attached to a rigid frame which bolts or screws to the top plate of the loudspeaker. The frame is usually located with holes which line up to pegs on the motor structure for alignment. In such designs, the loudspeaker must be removed from its mounting location to perform the repair.

One product currently on the market, provides a woofer in which the motor structure (i.e. magnet, back plate, pole piece and top plate) is removed from the frame so that the voice coil can be inspected. However, the moving parts (roll, cone body, dust cap, voice coil and spider) remain attached to the loudspeaker's frame. Another product on the market, provides a cone loudspeaker which features a screw-down spacer between its dual spiders or rear suspensions. The spacer screws through the frame to the top plate of the loudspeaker. The screws do not provide the necessary physical constraints to align the voice coil within the magnetic gap. This is still done with gauges (alignment spacers). The surround is glued to the frame in a conventional manner and the spider is glued to the spacer. Accordingly, this product fails to provide for easy field replacement of its parts.

Additionally, a loudspeaker must be carefully optimized for its intended task. Changes in its moving mass, motor strength, voice coil winding length/gauge/thickness or suspension compliance radically affect the performance of the loudspeaker. There are inevitable tradeoffs in the process of loudspeaker design. These tradeoffs must be carefully balanced with the intended task of the loudspeaker in mind, i.e. concert sound reinforcement, automotive sub-bass, home-theater, etc. With woofers, the intended enclosure type affects the design of the driver as well.

Ideally, an end user chooses a loudspeaker which will work best in his or her intended application. The most expensive components of a loudspeaker are its non-moving parts, which generally include the loudspeaker frame, and the motor structure. The moving parts of the loudspeaker generally represent a smaller portion of the total cost of the loudspeaker. If the user's operating conditions change, the loudspeaker may no longer be well-suited and is likely to be replaced with a more appropriate loudspeaker. Such is the case even if there is nothing wrong with the original loudspeaker and usually amounts to a relatively significant expenditure each time the operating conditions change.

Some existing small dome loudspeakers, primarily tweeters, and compression drivers feature the ability to remove and replace their moving parts, in the event of failure. Different impedance diaphragms are offered that will work in the same motor structure. The basic mission of the loudspeaker is not changed, only the load presented to the amplifier. However, the prior art fails to provide for reconfiguring the same motor structure in the field for different applications and enclosure types, specifically for low frequency woofers.

Additionally, the prior art fails to provide for a loudspeaker design which provides for relatively quick field replacement of the moving parts of a cone type loudspeaker, and in more particular to cone type loudspeakers which feature a rear suspension or spider in addition to the surround. The prior art also fails to provide a surround which is attached to the outer edge of the loudspeaker frame for improved overall displacement capability. Furthermore, the prior art fails to provide for a removable surround. It is therefore, to the effective resolution of the aforementioned problems and shortcomings of the prior art that the present invention is directed.

SUMMARY OF THE INVENTION

The present invention provides an improved surround design for a loudspeaker assembly wherein the outside edge of the surround is attached to the outer edge of the loudspeaker's frame via a fixed or removable means. When removably attached, access to the mounting holes of the loudspeaker frame is accomplished or provided by moving the roll to one side, prior to the attachment of the securing means. The method of attachment can vary, and in several embodiments includes the use of an annular o-ring, while in another attaching embodiment the use of a locking finger is provided.

The present invention provides for the improvement of overall displacement capability of the loudspeaker by allowing the use of the space typically reserved only for the loudspeaker's mounting flange for larger or oversized surrounds and/or greater cone area. The present invention allows for increased cone displacement for any given loudspeaker diameter. Thus, for a given outside loudspeaker diameter and a given effective cone area, the present invention permits the use of a surround with a much larger cross-sectional diameter, as compared to conventional designs. Because of the increased displacement capability, the present invention allows for the design of long-excursion loudspeakers which can outperform conventional loudspeakers of equal outside diameters using conventional surrounds.

The larger rolls or surrounds also permit longer excursion, as compared to smaller rolls, with a lesser degree of roll deformation for a given excursion. Under high-excursion demands the larger rolls also provide a more consistent compliance and better cone centering ability.

By moving the outer attachment point of the roll to the outside of the loudspeaker frame, a larger effective cone area is achieved for a given frame diameter (outside diameter). Thus, the design of smaller outside diameter loudspeakers with equal effective cone area as larger outside diameter conventional loudspeakers can be provided, without sacrificing the surround's roll diameter, which would affect the excursion capability. Furthermore, the present invention also permits increases in both cone area and excursion capability by providing a larger roll and larger cone area for a given frame diameter (outside diameter).

Additionally, the present invention allows the surround's roll to enclose the loudspeaker's mounting holes, thus achieving an excellent enclosure seal. Any air leaks around the bolts/screws are not important, as they are still within the enclosure. The enclosure seal is important for the linear performance of enclosed low frequency systems. Also by enclosing the loudspeaker's mounting holes, the mounting screws are concealed which makes for a cleaner appearance.

By providing a removable attachment between the surround and loudspeaker frame, the present invention provides a method for quickly replacing the moving parts of a cone type loudspeaker, and in particular for loudspeakers which feature a rear suspension or spider in addition to the surround. To allow for the quick replacement feature of the present invention the following must be provided (1) a removable/replaceable surround to loudspeaker frame attachment; (2) a removable/replaceable spider to loudspeaker frame attachment which also ensures proper centering of the voice coil in the magnetic gap; and (3) a removable/replaceable electrical contact for the voice coil circuit.

The present invention allows for moving parts replacement which is achieved without the use of adhesives, thus, eliminating adhesive-curing time and adhesive shelf-life problems, as well as the environmental impact of adhesives. The moving parts can be replaced without removing the loudspeaker frame from its mounting surface or enclosure. Thus, field service is greatly facilitated resulting in substantial time savings. For example, during a musical performance, a failed loudspeaker could be repaired in a matter of seconds. Furthermore, the present invention allows for the servicing of loudspeakers by personnel having a modest amount of technical prowess and also allows the loudspeaker to be diagnosed without destroying the loudspeaker.

The present invention allows for reconfiguring a loudspeaker for different tasks or enclosure types by replacing the moving parts with a pre-engineered set of new moving parts better suited for the desired task. Such reconfiguration can be accomplished in the field without the need for specialized technicians, tools or adhesives. Thus, the user can optimize the loudspeaker for its intended use with the knowledge that the loudspeaker can be reconfigured for a minimal cost if the user's requirements change. Furthermore, the loudspeaker is easily upgraded to the latest specifications at a minimal cost, while retaining the existing loudspeaker frame and motor structure, as product improvements are made.

As stated above, the loudspeaker frame and motor structure generally constitute the most expensive components of the loudspeaker. With the present invention, these components are not replaced, as only the removal of the moving parts of the loudspeaker are required for reconfiguration. As the moving parts are relatively inexpensive as compared to the fixed parts of the loudspeaker, the present invention provides a cost effective method of upgrading a loudspeaker to meet a user's requirements. Furthermore, such upgrading or reconfiguration can take place in the field.

The present invention reduces waste and cost by allowing the same loudspeaker frame and motor structure to be reused over and over. Also, a dealer of loudspeakers can carry a wide range of performance options by stocking a nominal number of "back ends" (motor structures, loudspeaker frames), while keeping a wider variety of the relatively less expensive "front ends" (moving assemblies). Accordingly, the present allows a loudspeaker dealer to effectively stock a very extensive loudspeaker line at a much reduced cost.

Accordingly, it is an object of the present invention to provide an improved surround design for a loudspeaker wherein the overall displacement capability of the loudspeaker is improved.

It is another object of the present invention to provide an improved surround design for a loudspeaker which allows for increased cone displacement for any given loudspeaker diameter.

It is yet another object of the present invention to provide an improved surround design for a loudspeaker which allows for a longer excursion with a lesser degree of roll deformation for a given excursion.

It is still another object of the present invention to provide an improved surround design for a loudspeaker which provides a method for quickly replacing the moving parts of a cone type loudspeaker.

It is even still another object of the present invention to provide an improved surround design for a loudspeaker which allows for a loudspeaker to be properly repaired or serviced by personnel having a modest amount of technical skill in loudspeaker design or technology.

It is a further object of the present invention to provide an improved surround design for a loudspeaker which allows for reconfiguring of the same motor structure in the field for different applications and enclosure types.

In accordance with these and other objects which will become apparent hereinafter, the instant invention will now be described with particular reference to the accompanying drawings.

BRIEF DESCRIPTION OF THE DRAWINGS

The invention may be better understood by reference to the drawings in which.

DESCRIPTION OF THE PREFERRED EMBODIMENTS

Figure 1:
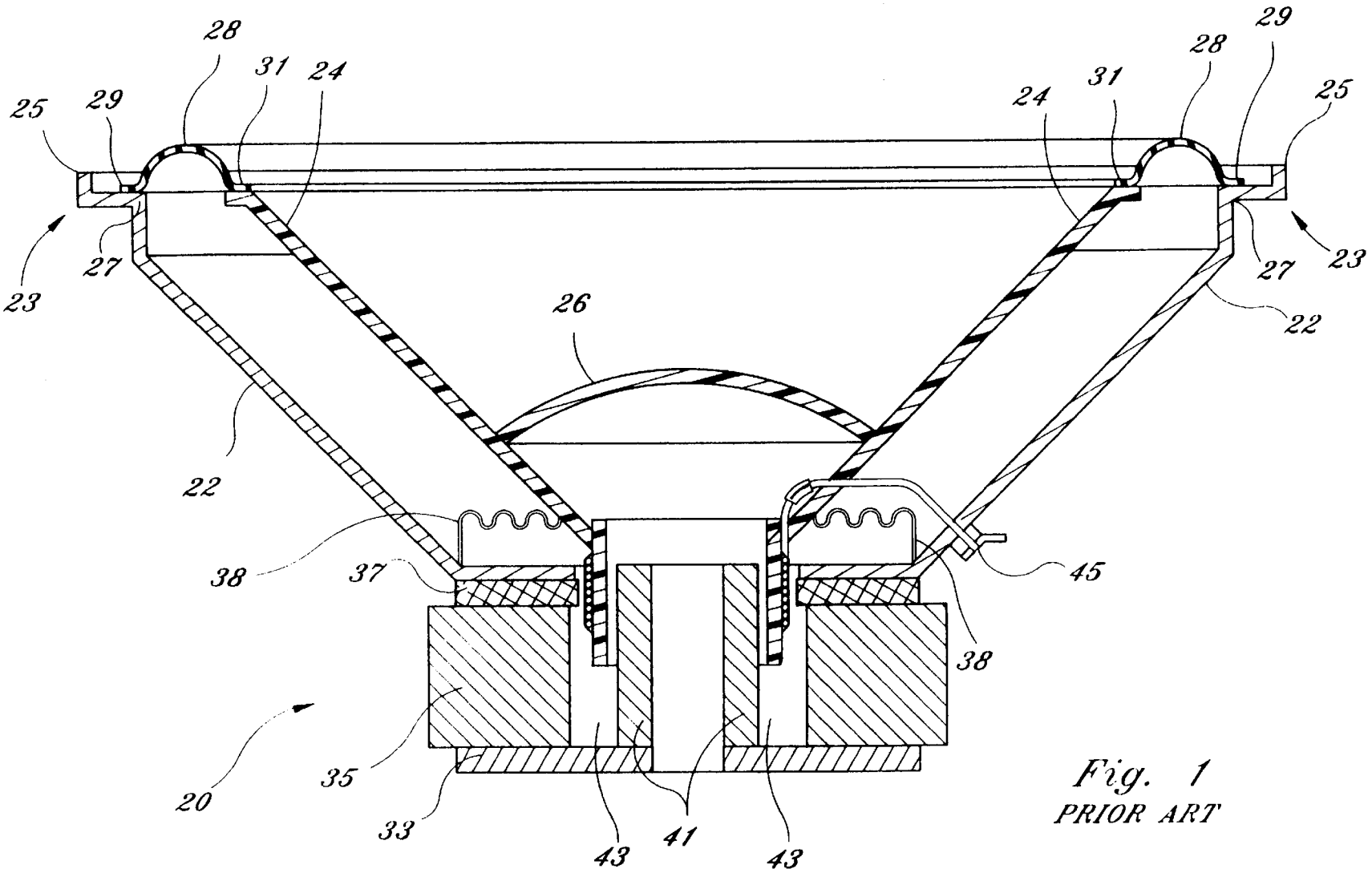
Fig. 1 PRIOR ART
FIG. 1 is a side view of a prior art loudspeaker system.

FIG. 1 illustrates a prior art loudspeaker generally designated as 20. Loudspeaker 20 includes a loudspeaker frame 22 having an outer mounting flange or rim 23. Mounting flange 23 includes an outside edge 25 and an inner edge 27. A front end suspension 28, commonly referred to as a "surround" or "roll", is shown attached to at its outside peripheral or edge 29 to inner peripheral or edge 27 of mounting flange 23. The inner edge 31 of annular surround 28 is shown attached cone diaphragm 24 at its outer peripheral. Surround 28 is attached to mounting flange 23 and cone 24 by conventional means in the industry such as the application of adhesives.

Loudspeaker 20 also includes a top plate 37, magnet 35, back plate 33, pole piece 41 and voice coil 43, as well as a spider 38. A magnetic gap is created between the inner edge of top plate 37 and pole piece 41. A dust cap 26, preferably is provided to prevent foreign particles from entering the gap area. Wiring 45 is also provided.

Figure 2:
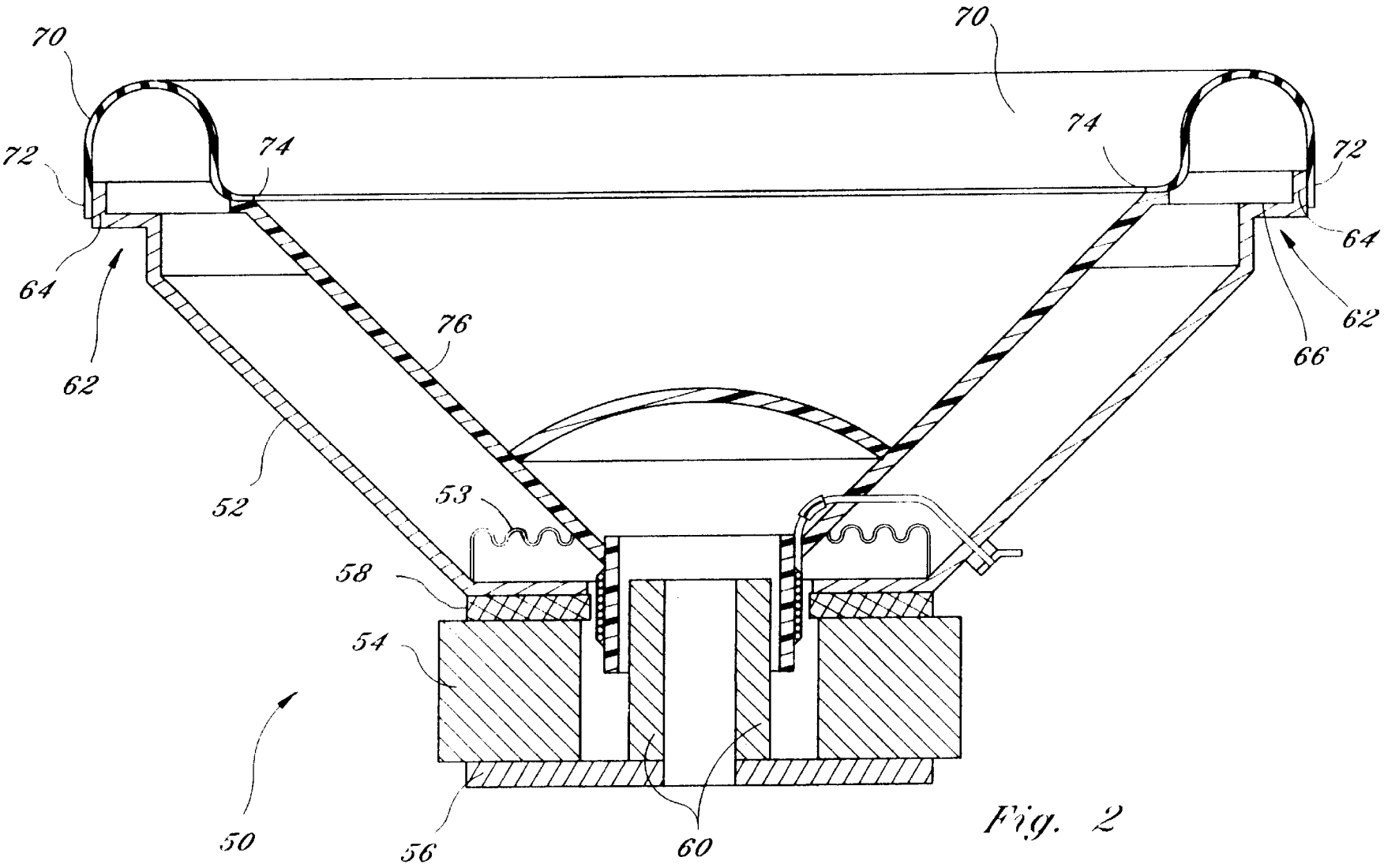
FIG. 2 is a side view of the present invention loudspeaker design.

FIG. 2 illustrates a similar view as FIG. 1, however, a loudspeaker 50 is shown incorporating some of the features of the present invention. Magnet 54, back plate 56 and top plate 58 remain and operate the same as like elements shown in FIG. 1. Loudspeaker 50 is also provided with a spider 53. However, as seen in FIG. 2, annular surround 70 is shown attached at its first outer peripheral or edge 72 to the outer peripheral or edge 64 of the mounting flange 62 of loudspeaker frame 52, instead of inner peripheral or edge 66. A second inner peripheral or edge 74 of annular surround 70 is shown attached to cone body or diaphragm 76 at its outer peripheral. Second edge 74 is attached to cone by conventional means such as adhesives. However, the attachment of first edge 72 to mounting flange 62 can be accomplished by several fixed and removable means. One fixed attachment mean would include the use of adhesives, which are in common use within the industry.

Preferably, edge 72 will be removably attached to outer edge 64 of annular mounting flange 62. Several of these removable attachment means will be illustrated and discussed below. However, it is to be understood that such fixed and removable attachment means, discussed herein, should not be considered exhaustive. Other attachment means, not shown, which will properly allow the first edge 72 of surround 70 to be attached to the outer edge 64 of mounting flange 62 are also within the scope of the present invention.

Figure 3A:
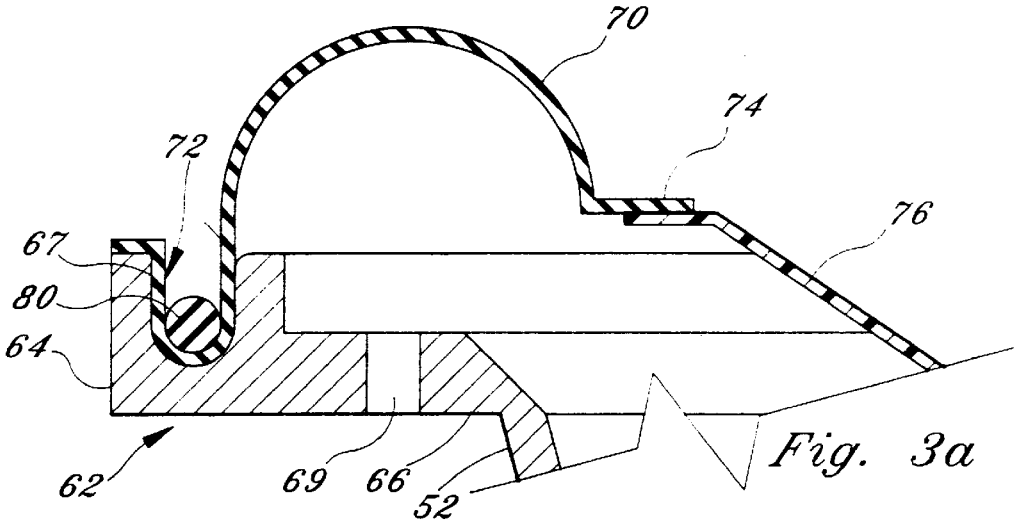
FIG. 3*a* is a cut away perspective view of a first removable surround to loudspeaker frame attachment embodiment of the present invention.

FIG. 3*a* illustrates a first embodiment for removably attaching outer or first edge 72 of annular surround 70 to the outside edge 64 of annular mounting flange 62 for loudspeaker frame 52. The second end 74 of surround 70 is shown conventionally attached to cone body 76. An annular groove 67 is formed at and around outside edge 64. A portion of edge 72 is shaped to conform to the shape of groove 67 and is disposed within groove 67. Once the relevant portion of edge 72 is disposed within groove 67, an annular o-ring 80 is pressure fitted within groove 67 and disposed over edge 72. Pressure fitted or elastic o-ring 80 maintains the attachment of edge 72 of surround 70 to outer edge 64 of mounting flange 62.

Access to mounting holes 69 of mounting flange 62 for loudspeaker frame 52 is achieved by removing pressure-fitted or elastic o-ring 80 and lifting surround 70 away, causing edge 72 to be withdrawn from groove 67 and ultimately exposing mounting holes 69. Once loudspeaker frame 52 has been securely mounted, by conventional means (not shown), edge 72 may be inserted or reinserted within groove 67 and o-ring 80 can be disposed to secure surround 70 to outer edge 64. Surround or roll 70 acts as an air-tight gasket when o-ring 80 is pressure fitted within groove 67. With this removable attachment embodiment of the present invention a relatively much larger portion of the loudspeaker's diameter is utilized, as compared to the prior art, when attaching surround 70.

Figure 3B:
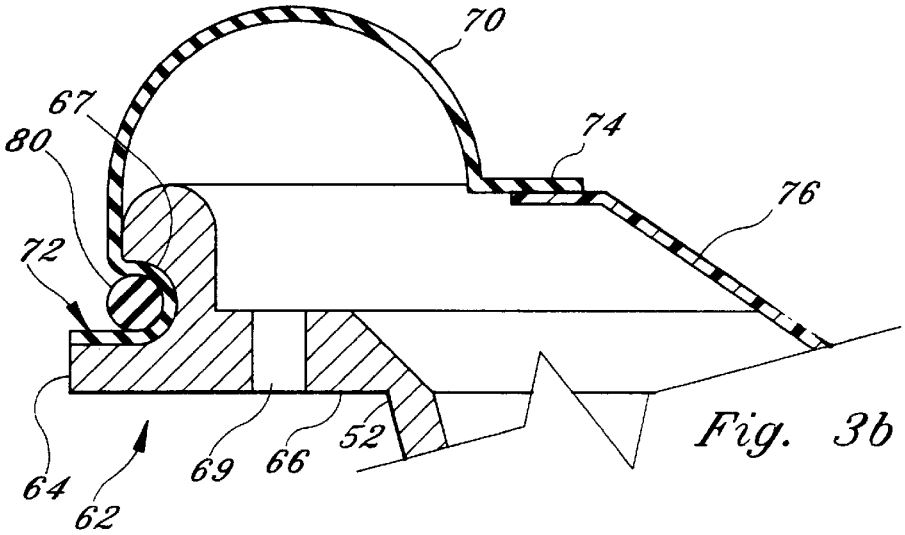
FIG. 3*b* is a cut away perspective view of a second removable surround to loudspeaker frame attachment embodiment of the present invention.

FIG. 3*b* illustrates the second embodiment which is the preferred embodiment for attaching outer edge 72 of annular surround 70 to the outside edge 64 of annular mounting flange 62 of loudspeaker frame 52. The second end 74 of surround 70 is shown conventionally attached to cone body 76. An annular groove 67 is formed at and around outside edge 64. A portion of edge 72 is shaped to conform to the shape of groove 67 and is disposed within groove 67. Once the relevant portion of edge 72 is disposed within groove 67, an annular o-ring 80 can be elastic or is pressure fitted within groove 67 and disposed over edge 72. Pressure fitted or elastic o-ring 80 maintains the attachment of edge 72 of surround 70 to outer edge 64 of mounting flange 62.

Access to mounting holes 69 of mounting flange 62 for loudspeaker frame 52 is again achieved by removing pressure-fitted o-ring 80 and lifting surround 70 away, causing edge 72 to be withdrawn from groove 67 and ultimately exposing mounting holes 69. Once loudspeaker frame 52 has been securely mounted by conventional means, edge 72 may be inserted or reinserted within groove 67 and o-ring 80 can be disposed to secure surround 70 to outer edge 64. Surround or roll 70 acts as an air-tight gasket when o-ring 80 is pressure fitted within groove 67. In this preferred embodiment, full use of loudspeaker 50's outside diameter is utilized.

Figure 3C:
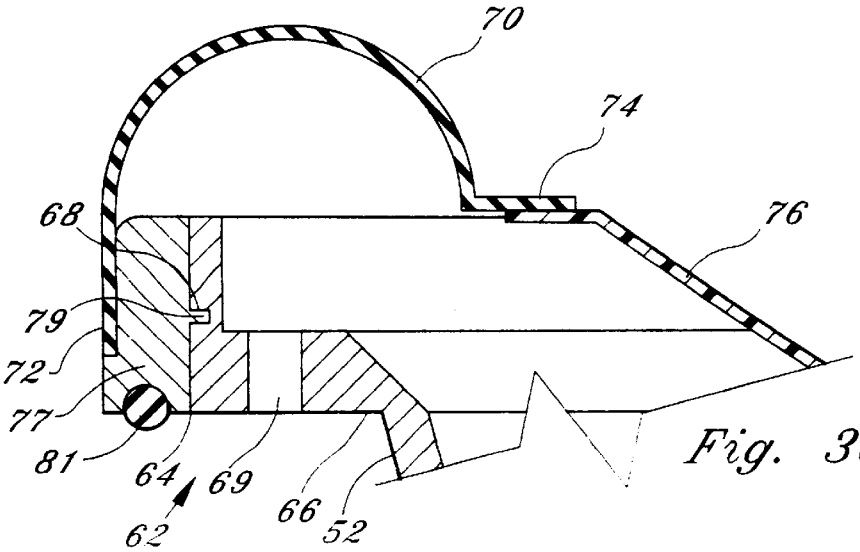
FIG. 3*c* is a cut away perspective view of a third removable surround to loudspeaker frame attachment embodiment of the present invention.
Figure 3D:
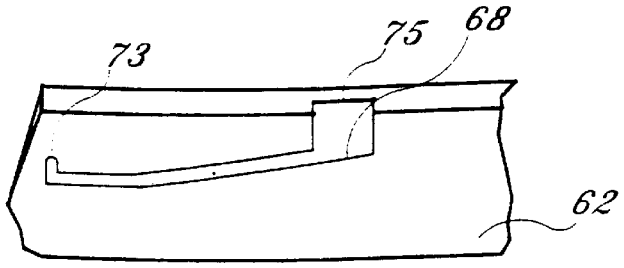
FIG. 3*d* is a front view illustrating the groove for the attachment embodiment of the present invention shown in FIG. 3*c;*
Figure 3E:
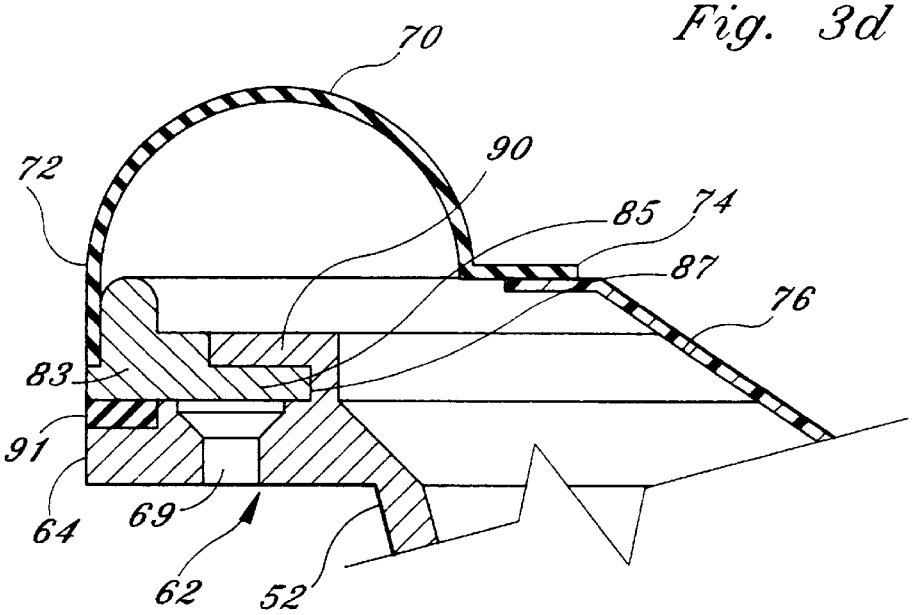
FIG. 3*e* is a cut away perspective view of a fourth removable surround to loudspeaker frame attachment embodiment of the present invention.
Figure 3F:
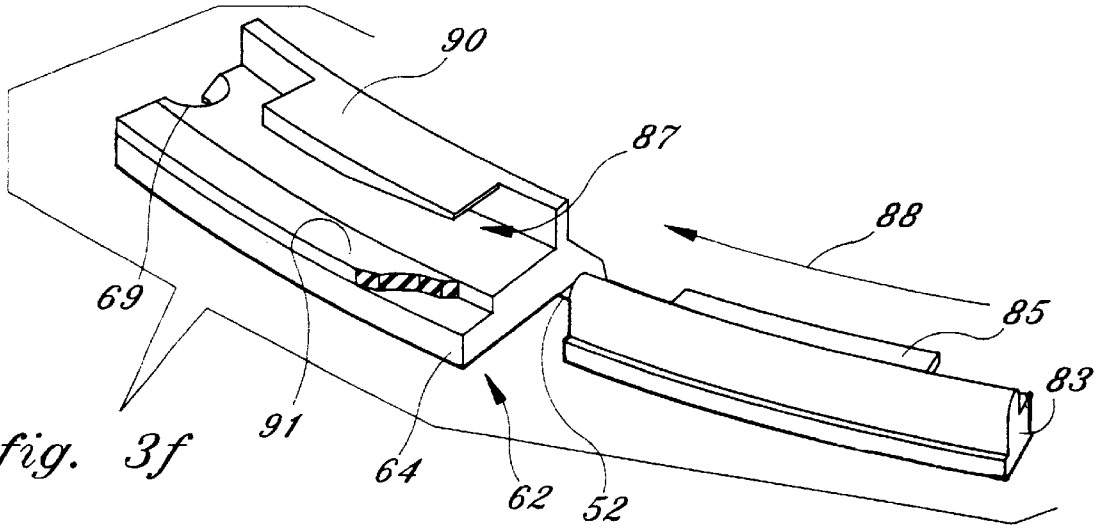
FIG. 3*f* is a perspective view illustrating the groove and locking member for the attachment embodiment of the present invention shown in FIG. 3*e;*
Figure 3G:
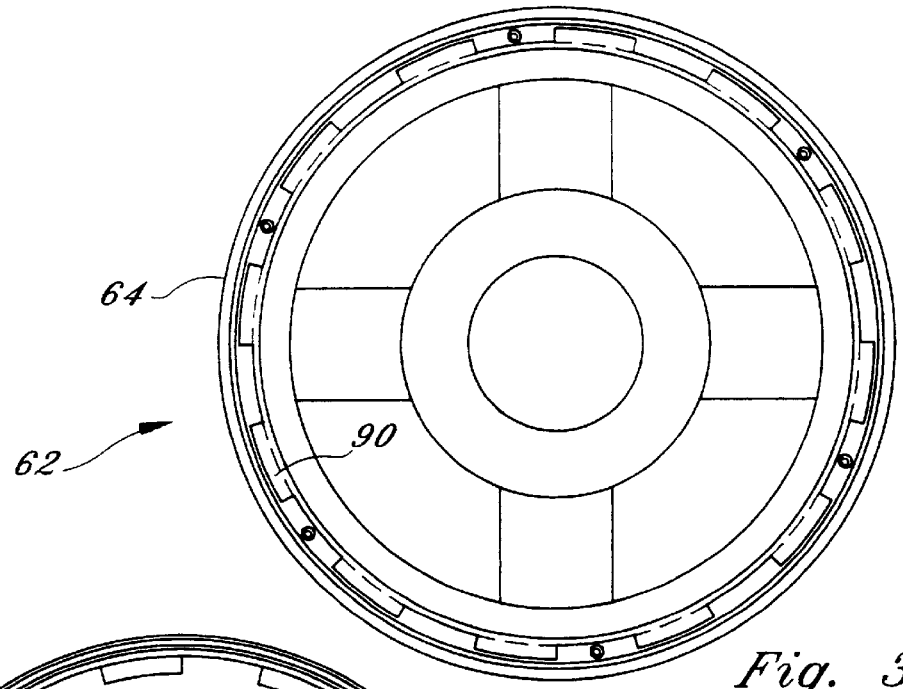
FIG. 3*g* is a top view illustrating the loudspeaker design of the invention shown in FIG. 3*e*, prior to the attachment of the locking member.
Figure 3H:
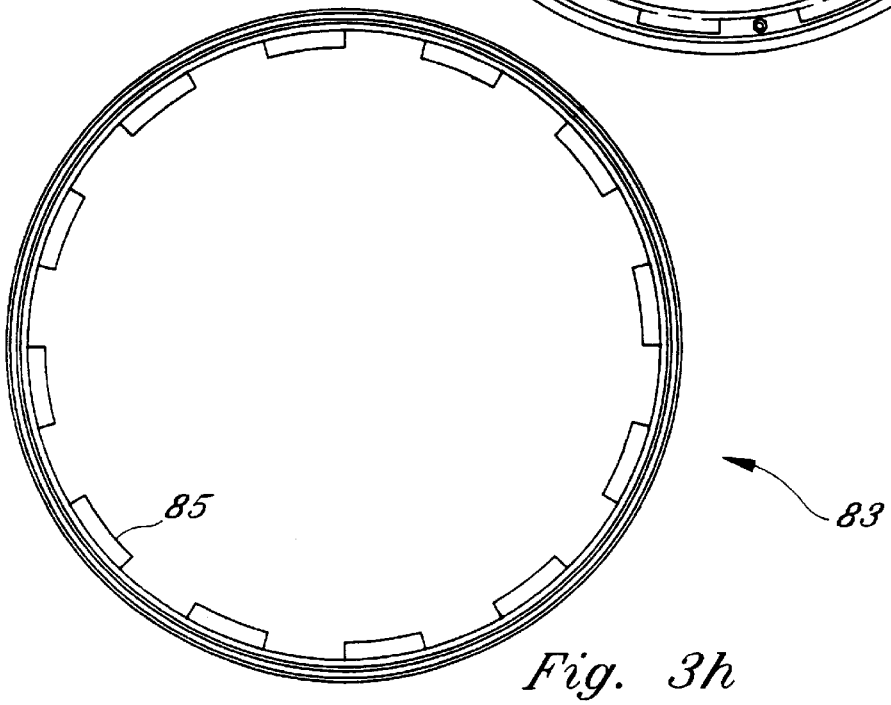
FIG. 3*h* is a top view illustrating the locking member of the invention shown in FIG. 3*e;*

FIG. 3*c* and 3*d* illustrate a third embodiment for attaching outer edge 72 of annular surround 70 to outside edge 64 of annular mounting flange 62 for loudspeaker frame 52. In this embodiment, a member 77, hereinafter referred to as a male locking bayonet ring, is attached to outer edge 72. The second end 74 of surround 70 is shown conventionally attached to cone body 76. Preferably, male bayonet ring 77 is permanently attached to surround 70 by conventional means such as the application of adhesives. However, such is not limiting and other permanent or removable attachment designs for the attachment of surround outer edge 72 to bayonet ring 77 are within the scope of the present invention. Preferably, bayonet ring 77 is constructed from plastic. However, such is also not limiting and other materials may be utilized for the construction of bayonet ring 77.

Bayonet ring 77 is provided with a protrusion 79 of a predefined shape which mates with a groove 68 disposed within outside edge 64 of mounting flange 62. A ring 77 is provided, preferably, having a plurality of protrusions 79 associated therewith. Corresponding ring grooves 68 are disposed around and associated with surround 70 and loudspeaker frame 52, respectively. When attaching first edge 72 of surround 70 to loudspeaker frame 52, protrusion 79 is aligned at the open end 75 of groove 68. The twisting of cone body 76, in one direction, causes protrusion 79 to travel along groove 68 until it snaps and locks into place at a notched closed end 73 of groove 68, thus securely locking or attaching surround 70 to loudspeaker frame 52. Foam gasket 81 provides spring action, forcing and locking protrusion 79 into notch 73.

A twist of cone body 76, in the opposite direction, unsnaps protrusion 79 from end 73, allowing protrusion to travel the opposite direction along groove 68 towards and out of the open end 75 of groove 68, and ultimately causing the detachment of surround 70 from loudspeaker frame 52. In this embodiment, full use of loudspeaker 50's outside diameter is utilized.

Access to mounting holes 69 is achieved by removing protrusion 79 out of groove 68, which detaches surround 70 from mounting flange 62, thus allowing surround 70, ring 77 and gasket 81 to be lifted away from mounting flange 62 to expose mounting holes 69. Once loudspeaker frame 52 has been securely mounted by conventional means, protrusion 79 is inserted or reinserted within groove 68 and locked as described above, to secure surround 70 to outer edge 64, via bayonet ring 77.

In this embodiment, as the twisting of the cone body 76 is required to securely retain protrusion 79 within closed end 73 of groove 68, the spider stand off must also be removable, as will be fully discussed below. Accordingly, the whole front end of loudspeaker 50 must be removable with respect to this removable surround attachment embodiment. Additionally, the twisting of the front end properly into place, also causes the crushing of sealing o-ring 81 against mounting baffle (not shown), thus effecting a seal, not only between loudspeaker frame 52 and roll 70, but also between loudspeaker 50 and the loudspeaker enclosure or baffle (not shown). As such, this embodiment is preferably utilized with smooth mounting surfaces.

FIG. 3*e*, 3*f*, 3*g* and 3*h* illustrate a fourth embodiment for attaching outer edge 72 of annular surround 70 to outside edge 64 of annular mounting flange 62 for loudspeaker frame 52. In this embodiment, a male locking member 83 is attached to outer edge 72. The second end 74 of surround 70 is shown conventionally attached to cone body 76, as with the other attachment embodiments of the present invention. Preferably, male locking member 83 is permanently attached to surround 70 by conventional means such as the application of adhesives. However, such is not limiting and other permanent or removable attachment designs between surround edge 72 and locking member 83 are within the scope of the present invention. Preferably, locking member 83 is constructed from plastic. However, such is also not limiting and other materials may be utilized for the construction of locking member 83.

Locking member 83 is provided with at least one, and preferably with a plurality of fingers 85 which mate with corresponding finger grooves 87 disposed within mounting flange 62. Locking fingers 85 and grooves 87 are disposed around and associated with surround 70 and loudspeaker frame 52, respectively. Groove 87 is defined by a top wall 90 and mounting flange 62 and is in communication with mounting hole 69 which is disposed within an adjacent portion of mounting flange 62. When attaching, first edge 72 of surround 70 is attached to locking member 83 and locking member 83 is attached to loudspeaker frame 52, by inserting locking finger 85 within groove 87. The twisting of cone body 76, in the direction of arrow 88, causes finger 85 to be properly locked within groove 87, thus securely locking or attaching surround 70 to loudspeaker frame 52. A twist of cone body 76, in the opposite direction, causes the detachment of surround 70 from loudspeaker frame 52. In this embodiment, full use of loudspeaker 50's outside diameter is utilized.

Access to mounting holes 69 is achieved by rotating roll 70, thus freeing locking fingers 85, to allow the front end to be completely removed, discussed below, or to allow surround 70 to be lifted away from mounting flange 62 to expose mounting holes 69. As with the third embodiment, the spider stand (not shown) must also be removable. However, unlike the third embodiment, this attachment design is not dependent on a smooth mounting surface.

In use, as the front end is twisted properly into place, compression gasket 91, preferably constructed from a foam material, effects a seal between roll 70 and basket or loudspeaker frame 52. With this embodiment, mounting holes 69 can be placed to the extreme outside edge of loudspeaker frame 52 for a better "bite" into the enclosure or baffle, as mounting screws (not shown) stay further away from the loudspeaker's mounting cut-out.

Thus, the present invention provides an improved surround 70 design for a loudspeaker 50 assembly wherein an outside edge 72 of surround 70 is attached to an outer edge of the loudspeaker's frame 52 via a permanent or removable means. When removably attached, access to the mounting holes 69 of the loudspeaker frame 52 is accomplished or provided by moving roll 70 to one side, prior to the attachment of the securing means. The method of attachment can vary, and in several embodiments includes the use of an annular o-ring 80, while in another attaching embodiment the use of a locking finger is provided.

The present invention provides for the improvement of overall volume displacement capability of loudspeaker 50 by allowing the use of the space typically reserved only for the loudspeaker's mounting flange 62, for larger or oversized surrounds 70 and/or greater cone area, thus allowing for increased volume displacement for any given loudspeaker diameter. Thus, for a given outside loudspeaker diameter and a given effective cone area, the present invention permits the use of a surround 70 with a much larger cross-sectional diameter, as compared to conventional designs. Because of the increased volume displacement capability, the present invention allows for the design of long-excursion loudspeakers which can outperform conventional loudspeakers of equal outside diameters using conventional surrounds.

The larger rolls or surrounds 70 also permit longer excursion, as compared to smaller rolls, with a lesser degree of roll deformation for a given excursion. Under high-excursion demands the larger rolls also provide a more consistent compliance and better cone centering ability.

Thus summarizing, by moving the outer attachment point of annular roll 70 to outside edge 64 of loudspeaker frame 52, a larger effective cone area is achieved for a given frame diameter (outside diameter). Thus, the design of smaller outside diameter loudspeakers with equal effective cone area as larger outside diameter conventional loudspeakers can be provided, without sacrificing the surround's roll diameter, which would affect the excursion capability. Furthermore, this embodiment of the present invention also permits increases in both cone area and excursion capability by providing a larger roll 70 and a larger cone area.

Furthermore, as stated above, the present invention allows the annular surround 70 to enclose the loudspeaker's mounting holes 69, thus achieving an excellent enclosure seal. The enclosure seal is important for the linear performance of enclosed low frequency systems. Also by enclosing loudspeaker's mounting holes 69, the mounting screws (not shown) are concealed which makes for a cleaner appearance.

Figure 3I:
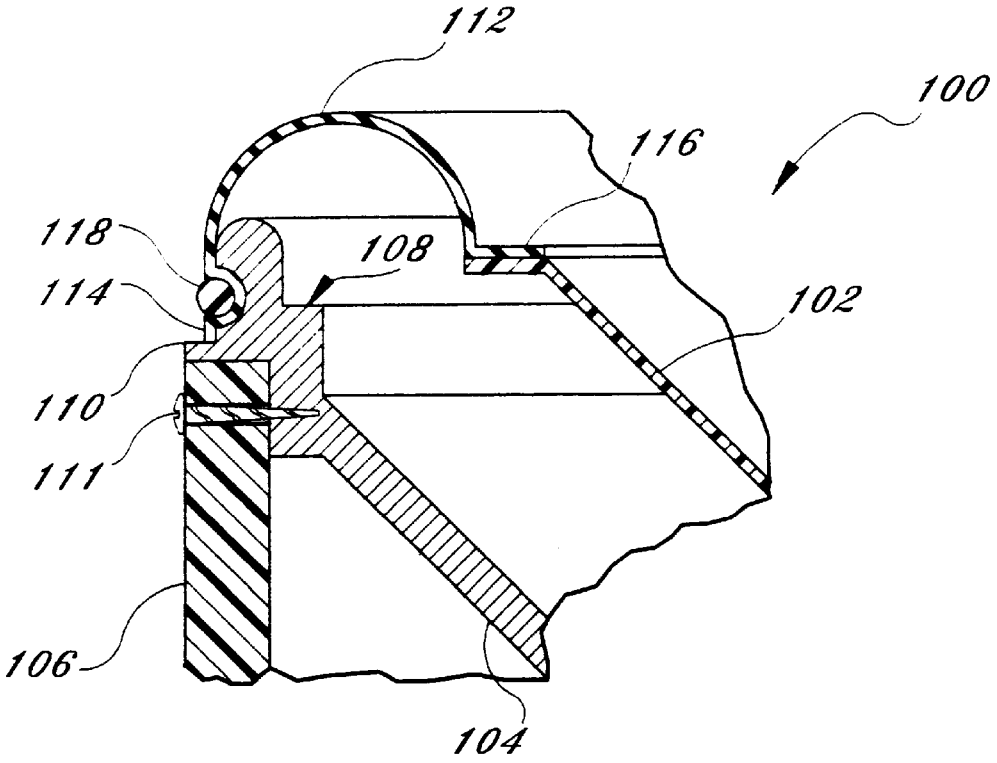
FIG. 3*i* is cut away section view of a surround to loudspeaker frame attachment embodiment of the present invention for use with "tube" (cylindrical) type loudspeaker systems.
Figure 3J:
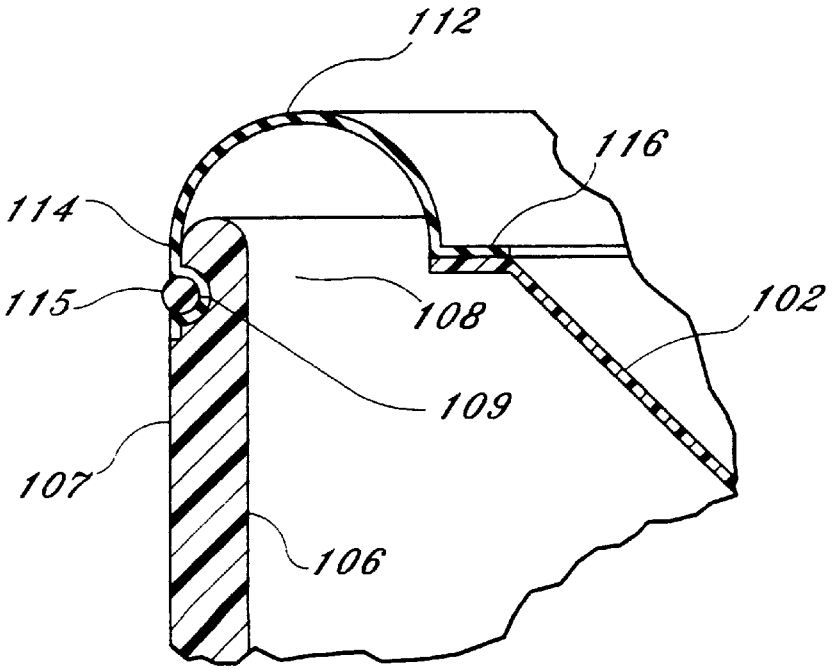
FIG. 3*j* is cut away perspective view of a surround to tube wall attachment embodiment of the present invention for use with "tube" (cylindrical) type loudspeaker systems.

FIGS. 3*i* and 3*j* illustrate alternative embodiments for attaching the annular surround in accordance with the teachings of the present invention (attaching over the loudspeaker frame) for "tube" type loudspeaker system applications. As seen in FIG. 3*i*, a first outer peripheral or edge 114 of annular surround 112 is shown removably attached to outer end 110 of annular mounting rim 108 for loudspeaker frame 104. A pressure-fitted or elastic annular o-ring 118 is disposed over edge 114, similar to the surround attachment embodiment, shown in 3*b*. Other surround attachment embodiments, discussed above, may also be utilized with "tube" type loudspeaker system 100. Access to the mounting holes (not shown) for attaching loudspeaker frame 104 to tube wall 106, is achieved by removing o-ring 118 and lifting surround 112, similarly to the removable attachment embodiments described above. Alternatively, surround 112 may be permanently attached to outer edge 110 of mounting flange 108, by conventional means such as adhesives. Loudspeaker frame 104 is then glued or pressure fitted into tube 106 or attached by a screw 111 disposed through tube 106. However, such is not limiting, and other attachment embodiments are within the scope of the present invention.

Loudspeaker frame 104 is modified to fit within the inner diameter of tube wall 106, as well as being attached to tube wall 106. The second inner peripheral or edge 116 of annular surround 112 is shown conventionally attached to cone body 102 at its outer peripheral. This application of the present invention, with "tube" type loudspeaker systems, allows for maximization of cone area, increased roll linearity, and higher degrees of linear excursion. Furthermore, the removability and replaceability features of the present invention are available for "tube" type loudspeaker systems.

FIG. 3*j* illustrates a second embodiment of the present invention utilized with "tube" type loudspeaker systems. In this embodiment the loudspeaker frame normally associated with loudspeakers is removed. A first outer peripheral or edge 114 of annular surround 112 is shown removably attached to an annular outside surface 107 of tube wall 106. An annular groove 109 is formed within tube wall 106 and a adjacent portion of first edge 114 is shaped to allow insertion of the adjacent portion within groove 109 for attachment purposes. When attaching surround 112 to tube wall 106, after the adjacent portion of edge 114 is disposed within groove 109, a pressure-fitted or elastic annular o-ring 115 is disposed over the adjacent portion of edge 114 to provide removable attachment between surround 112 and tube wall 106. Other surround attachment embodiments, discussed above, may also be utilized. Alternatively, surround 112 may be permanently attached to tube wall 106 by conventional means such as the application of adhesives.

The second inner peripheral or edge 116 of annular surround 112 is shown conventionally attached to cone body 102 at its outer peripheral. This application of the present invention, with "tube" type loudspeaker systems, allows for maximization of cone area, increased roll linearity, and higher degrees of linear excursion, as well as improving the overall clearance for the moving parts. The elimination of the conventional loudspeaker frame provides reductions in costs as well as design complexity. Furthermore, the removability and replaceability features of the present invention are also available for "tube" type loudspeaker systems.

In all embodiments of the present invention, an oversized surround or roll may be provided. However, the present invention may be utilized and constructed with conventional surrounds typically used in loudspeaker applications.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A loudspeaker, comprising:

a motor structure;

a frame having an inner surface, an outer surface spaced from said inner surface, a first end and a second end, said first end being connected said motor structure, said second end including an edge portion extending between said inner and outer surfaces;

a cone having a first end connected to said motor structure and a second end, said cone facing said inner surface of said frame;

a surround having an inner edge and an outer edge spaced from said inner edge, said inner edge being connected to said second end of said cone, said outer edge being connected to said outer surface of said frame so that said surround extends over said edge portion of said second end of said frame.

2. The loudspeaker of claim 1 in which said outer edge of said surround is substantially permanently connected to said outer surface of said frame.

3. The loudspeaker of claim 1 in which said outer edge of said surround is removably connected to said outer surface of said frame.

4. The loudspeaker of claim 1 in which said second end of said frame is formed with a flange having a number of mounting holes, said surround being mounted to said frame so that said mounting holes are substantially covered by said surround.

5. The loudspeaker of claim 1 in which said second end of said frame is formed with a peripheral groove, at least a portion of said outer edge of said surround being insertable within said groove and retained in place therein by a mounting device.

6. The loudspeaker of claim 5 in which said mounting device is an annular ring.

7. The loudspeaker of claim 5 in which said peripheral groove is formed in said second end of said frame beginning at said outer surface thereof and extending in a direction toward said inner surface of said frame.

8. The loudspeaker of claim 5 in which said second end of said frame includes a first surface and a second surface spaced from said first surface, said first and second surfaces being substantially parallel to one another and substantially perpendicular to at least a portion of said outer surface of said frame at said second end thereof, said peripheral groove being formed in said frame beginning at said first surface and extending toward said second surface.

9. The loudspeaker of claim 1 in which said frame is substantially tubular in shape.

10. A loudspeaker, comprising:

a motor structure;

a frame having an inner surface, an outer surface, a first end and a second end, said first end having connected to said motor structure, said second end being formed with a flange having a number of mounting holes;

a cone having a first end connected to said motor structure and a second end, said cone having said inner surface facing said frame;

a surround having an inner edge and an outer edge spaced from said inner edge, said inner edge being connected to said second end of said cone, said outer edge being connected to said outer surface of said frame at said second end thereof so that said mounting holes in said flange are substantially covered by said surround.

11. The loudspeaker of claim 10 in which said second end of said frame is formed with a peripheral groove, at least a portion of said outer edge of said surround being insertable within said groove and retained in place therein by a mounting device.

12. The loudspeaker of claim 11 in which said mounting device is an annular ring.

13. The loudspeaker of claim 11 in which said peripheral groove is formed in said second end of said frame beginning at said outer surface thereof and extending in a direction toward said inner surface of said frame.

14. The loudspeaker of claim 11 in which said second end of said frame includes a first surface and a second surface spaced from said first surface, said first and second surfaces being substantially parallel to one another and substantially perpendicular to at least a portion of said outer surface of said frame at said second end thereof, said peripheral groove being formed in said frame beginning at said first surface and extending toward said second surface.

15. The method of removably attaching a surround to the frame of a loudspeaker, comprising:

(a) providing a frame with an inner surface, and outer surface, a first end connected to the motor structure of the loudspeaker and a second end;

(b) providing a peripheral groove in the outer surface of the frame and at the second end of the frame;

(c) inserting at least a portion of the outer edge of the surround into the peripheral groove;

(d) securing the outer edge of the surround within the peripheral groove.

16. The method of claim 15 in which step (d) comprises permanently affixing at least a portion of the outer edge of the surround within the peripheral groove.

17. The method of claim 15 in which step (d) comprises inserting an annular ring within the peripheral groove and into engagement with at least a portion of the outer edge of the surround to removably mount the surround to the frame.

* * * * *